US005356044A

United States Patent [19]

LaVange

[11] Patent Number: 5,356,044

[45] Date of Patent: Oct. 18, 1994

[54] TAMPER EVIDENT SEAL FOR DISPENSING CLOSURE

[75] Inventor: Donald LaVange, Cumberland, R.I.

[73] Assignee: Polytop Corporation, Slatersville, R.I.

[21] Appl. No.: 118,616

[22] Filed: Sep. 10, 1993

[51] Int. Cl.[5] ..... B67D 15/32

[52] U.S. Cl. ..... 222/153; 222/532; 222/536; 222/541

[58] Field of Search ..... 222/23, 153, 532, 536, 222/541, 556, 534

[56] References Cited

U.S. PATENT DOCUMENTS

| | | | |
|---|---|---|---|
| 3,702,165 | 11/1972 | Carow et al. | 222/541 |
| 4,081,108 | 3/1978 | Wilson et al. | 222/153 |
| 4,344,545 | 8/1982 | Aschberger et al. | 222/541 |
| 4,519,517 | 5/1985 | Walter | 222/541 |
| 4,595,123 | 6/1986 | Libit | 222/23 |
| 4,711,372 | 12/1987 | Gach | 222/153 |
| 4,763,801 | 8/1988 | Nycz | 215/203 |
| 4,775,065 | 10/1988 | Shastal | 215/235 |
| 4,941,592 | 7/1990 | Kitterman | 222/23 |
| 5,123,561 | 6/1992 | Gross | 220/254 |
| 5,201,440 | 4/1993 | Gross | 222/153 |

*Primary Examiner*—Andres Kashnikow
*Assistant Examiner*—Philippe Derakshani
*Attorney, Agent, or Firm*—Hoffman, Wasson & Gitler

[57] ABSTRACT

A tamper indicating seal for a dispensing closure that is secured to a container to discharge the contents thereof. Closure induces a depending skirt, and a planar top surface, with a cavity defined within the top surface. A spout is located within the cavity, and may be pivoted between a horizontal, closed position and a vertical, open position. The unique seal comprises a thin plastic tab, with frangible members depending below, to secure the tab to the upper surface of the spout in an overlying relationship. The frangible members are durable enough to form an effective seal, yet weak enough to fracture when the spout is pivoted toward its vertical position. The tab, when severed from the spout, is used as a proof of purchase indicator. The absence of the seal clearly indicates to the user that someone has attempted to gain access to the contents of the container.

7 Claims, 2 Drawing Sheets

TAMPER EVIDENT SEAL FOR DISPENSING CLOSURE

BACKGROUND OF THE INVENTION

1. Field of the Invention

This invention relates generally to dispensing closures that are secured to a container to discharge the contents thereof, and more particularly to a tamper evident seal that indicates that someone has attempted to gain access to the contents of the container. The same seal, one breached, functions as a proof of purchase tab.

2. Prior Art

Dispensing closures, comprising a closure body that is screwed, or otherwise secured, to the neck of a container, and a spout that is mounted within a cavity in the upper surface of the closure body for pivotal movement, are well known. A discharge opening is defined through the closure body, and a bore extends longitudinally through the spout. The spout has an enlarged, cylindrical base, and trunnions are formed on opposite sides of the base. The trunnions fit into grooves in the walls defining the cavity in the closure body, so that the spout may be pivoted between a normal horizontal orientation, and a vertical orientation.

In the horizontal orientation, the cylindrical base of the spout blocks the discharge opening, and seals the contents of the container. In the vertical orientation, the bore in the spout is aligned with the discharge opening, and the contents of the container may be discharged through the spout. The container may be formed of a plastic that is resilient enough to be squeezed to discharge the contents thereof, or the container may be formed of a rigid plastic or glass, so that the contents may only be discharged when the container is inverted.

Such dispensing closures may be used to dispense food products such as margarine, cooking oils, catsup, mustard, etc. However, the dispensing closures are also suitable for lotions, medicines, such as salves or ointments, and numerous other applications.

The assignee of the instant application, Polytop Corporation of Slatersville, R.I., holds several patents that disclose, in detail, dispensing closures using pivotal spouts to discharge the contents of the container to which the closure is secured. Representative patents are Hazard U.S. Pat. Nos. 3,655,099; Hazard U.S. Pat. No. 3,655,103; Hazard et al U.S. Pat. No. 3,718,238; and Hazard et al U.S. Pat. No. 3,957,181.

However, when known dispensing closures have been used for dispensing food products, or salves or ointments, concern has arisen about maintaining the sanitary condition of the product being dispensed. In order to insure the ultimate consumer that the product has not been tampered with, or exposed to ambient conditions, and that sanitary standards have been met and maintained, demands have been made for tamper evident seals. Such seals, must be low in cost, easy to apply, and compatible with existing packaging machinery and techniques.

One such seal is disclosed in U.S. Pat. No. 4,081,108, granted Mar. 28, 1978 to Woodrow S. Wilson and Robert E. Hazard and assigned to Polytop Corp. The Wilson et al patent provides a tamper evident seal that assumes the form of a relatively flexible strap (16) which connects the movable end of a spout (14) with the cap body (18) employed in such closure. The use of such a strap makes it possible to mold the spout and the cap as a unitary article (as shown in FIG. 3). The strap is shaped and dimensioned to facilitate location of the spout during assembly of the spout on the cap, or cap body, and if desired, functions as a cover for the bore (38) in the spout when the spout is assembled to the closure body, by inserting trunnions (42) into bearing slots (30, 32) in the closure body.

Another approach for providing a tamper evident seal for a dispensing closure is disclosed in U.S. Pat. No. 4,763,801, granted Aug. 16, 1988 to Joseph D. Nycz, and assigned to Owens-Illinois Closure Inc. Such patent discloses a dispensing closure (14) which is secured to the finish of a container. The closure includes a molded plastic body (20) with an irregular, generally horizontal top structure and a dispensing opening (50) in such top structure. A pivotable spout (22) is frictionally and pivotally attached to the top structure, and can be pivoted between a generally horizontal, closed position, and an upright, open position wherein the bore in the spout is aligned with the dispensing opening (as shown in FIG. 7). The closure further includes a dispensing control member (disc 24) which is rotatable in a horizontal plane with respect to the body portion, the disc having a slot (74) defined therein. The disc is capable of rotation to bring the slot into alignment with the pivotable spout, to permit the pivotable member to be pivoted through the slot from the closing position (FIGS. 4–5) to the open, or dispensing portion (FIG. 7). As the pivotable member is swung into its open position for the first time, bridge member (76) is severed, thus providing a visible indication to the consumer, or store employee, that someone has attempted to gain access to the contents of the container.

Several other tamper evident seals, of different constructions, have been developed in recent years. For example, see the removable flange (70) in U.S. Pat. No. 4,595,123, granted to S. M. Libit, that is secured to the top of a dispensing closure, in the vicinity of hinged cap (22) by depending bosses 81. The indicia formed in the container top, underlying the flange, is made visible by removal of the flange (as shown in FIGS. 7 & 9).

Additional tamper-indicating seals for plastic closures are shown in Shastal U.S. Pat. No. 4,775,065; Kitterman U.S. Pat. No. 4,941,592; Gross U.S. Pat. No. 5,123,561; and Gross U.S. Pat. No. 5,201,440.

While several of the patented closures cited above disclose tamper evident seals that have met with varying degrees of consumer acceptance, no known seal for dispensing closure has been devised to provide an effective, tamper evident seal and a proof of purchase indicator. Furthermore, no known seal has been devised that combines both of these qualities, into a simple, aesthetically pleasing, molding that is compatible with existing packaging equipment, and can be mass-produced at a minimum cost, per unit. Furthermore, such dual purpose seal must be strong enough to preclude unwarranted opening of the spout during shipment, yet weak enough to yield readily, and break away clearly from the spout, when the user attempts to open the spout for the first time.

SUMMARY OF THE INVENTION

Consequently, with the limitations of known tamper indicating seals, as applied to dispensing closures, clearly in mind, the instant invention relates to a tamper-indicating seal that combines, in a simple, yet elegant, manner, the functions of a seal and a proof-of-purchase tab. The novel seal is particularly well suited for use with dispensing closures that utilize a pivotable spout with a central bore for discharging the contents of the container to which the closure has been secured.

In a preferred embodiment, the novel seal assumes the form of a rectangular tab that is secured, by frangible ribs, to the upper surface of the spout, to retain the spout in its horizontal, closed position. The first time that the dispensing closure is opened, by exerting manual force on the free end of the spout, the webs are severed, the tab falls away from the spout, and the spout is pivoted upwardly to its vertical position. The tab may then be returned to the manufacturer for a cash rebate or other premium. The removal of the tab allows the user to use the dispensing closure, with its spout, in the usual manner, until the contents of the container have been discharged.

Alternatively, the tab may be integrally formed with, and secured to, the upper surface of the spout by a neck of reduced thickness. A recess is defined in the upper surface of the spout. When the tab is removed, either prior to opening the spout, or, alternatively, by the manual force applied to the spout during opening, any debris from the seal will fall into the recess and will not interfere with the pivotal movement of the spout.

Furthermore, the top surface of the tab is maintained in a smooth, and attractive, state, which is a favorable characteristic for dispensing closures for foods, medications, etc.

Numerous other advantages attributable to the instant tamper indicating seal, with frangible members that secure same to the top surface of the spout will become readily apparent when the appended drawings are construed in harmony with the following description of a preferred embodiment (FIGS. 1–7) of the invention, and one alternative embodiment (FIG. 8).

PREFERRED EMBODIMENT

Figure 1:
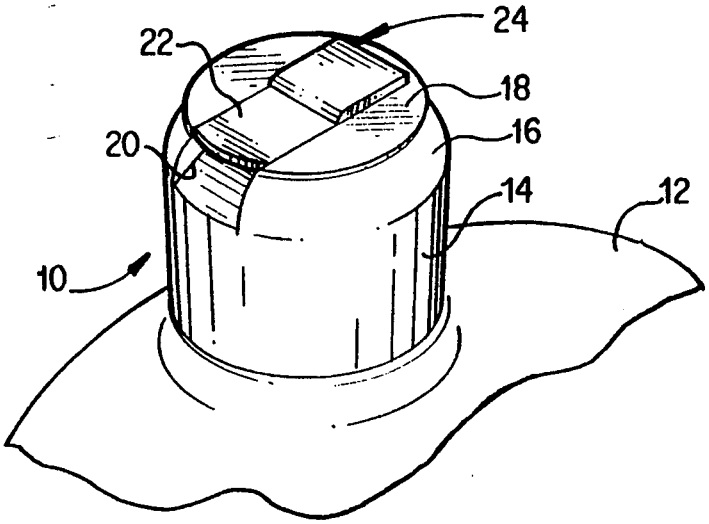
FIG. 1 is a perspective view of a preferred embodiment of a tamper evident seal constructed in accordance with the principles of the instant invention, such seal being secured to a spout on a dispensing closure retained on a container.

FIGS. 1–7 depict the preferred embodiment of the instant invention. FIG. 1 shows a dispensing closure, indicated generally by reference numeral 10, secured to the neck of a plastic container 12. Closure 10 comprises a depending skirt 14, an inwardly tapering annular section 16, and a planar top surface 18.

Figure 2:
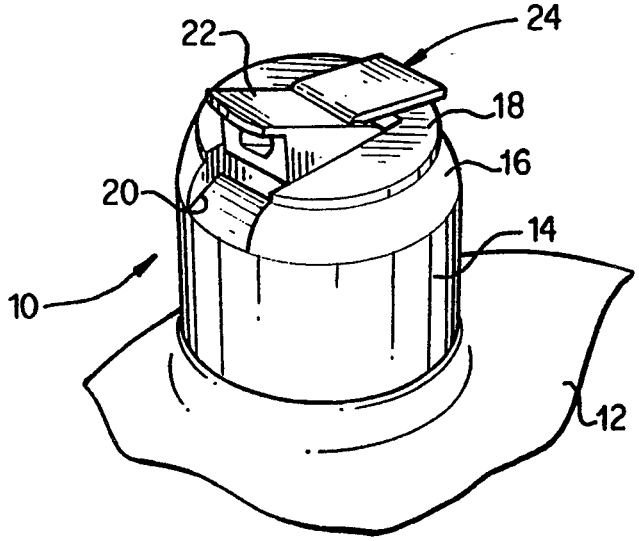
FIG. 2 is a similar perspective view showing the tamper evident seal being broken as the dispensing closure is opened for the first time.

A notch 20 in annular section 16 of closure 10 provides access to the protruding end of spout 22. A tamper indicating seal, indicated generally by reference numeral 24, is generally rectangular in shape when viewed from above, and is joined to, and aligned with, spout 22. The seal 24, prior to the initial opening of the spout, rests in a plane parallel to the top surface 18 of dispensing closure 10, and overlies the rear half of the spout. FIG. 1 shows seal 24 retaining spout 22 in its closed position, while FIG. 2 shows spout 22 being pivoted upwardly and seal 24 starting to yield in response to such movement.

Figure 3:
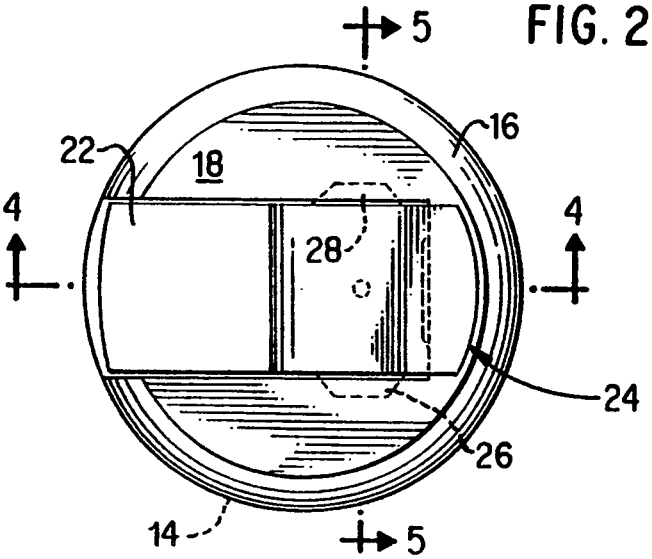
FIG. 3 is a top plan view of the dispensing closure and tamper evident seal.
Figure 4:
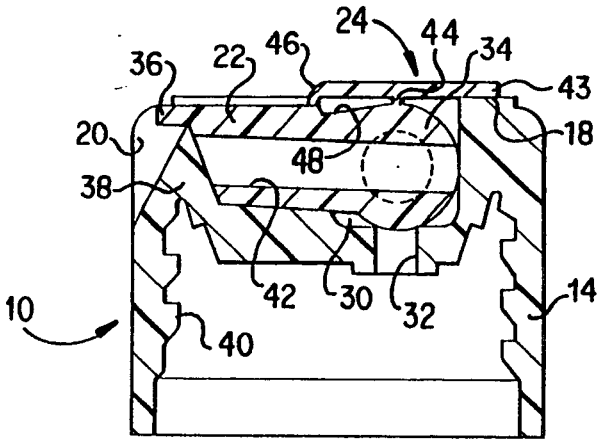
FIG. 4 is a vertical, cross-sectional view of the dispensing closure and tamper-evident tab, such view being taken along line 4—4 in FIG. 3 and in the direction indicated.
Figure 5:
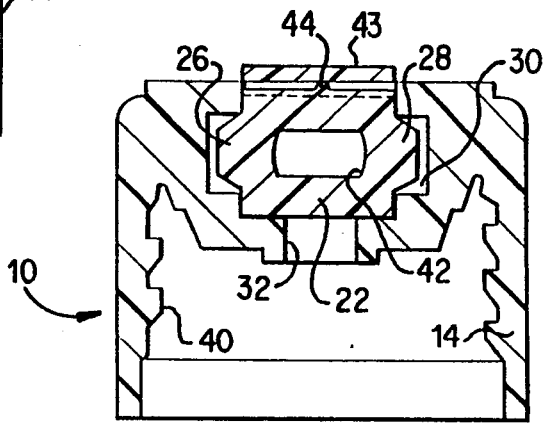
FIG. 5 is a vertical, cross-sectional view of the dispensing closure and tamper evident seal, such view being taken along line 5—5 in FIG. 3 and in the direction indicated.

FIGS. 3–5 reveal, on an enlarged scale, additional structural relationships between spout 22 and overlying seal 24. For example, the trunnions 26, 28 are formed on opposite sides of spout 22. The trunnions frictionally fit into complementary slots, grooves, apertures, or the like, defined in the sidewalls of the cavity 30 defined in the upper surface of the dispensing closure. The trunnions and slots cooperate to allow the spout to be pivoted from its normal, horizontally disposed closed position in FIG. 1, to its upright, open position in FIG. 2.

A discharge aperture 32 extends through the lower wall of dispensing closure 10, and communicates with cavity 30. However, an enlarged, cylindrical base 34 is formed at the inner end of spout 22, and the base normally blocks communication between aperture 32 and cavity 30, as shown in FIG. 4. A lip 36 is located at the forward end of spout 22, and such lip usually rests upon an upstanding wall 38, in the vicinity of notch 20 in annular section 16. Internal threads 40, on the interior surface of the depending cylindrical skirt 14 of closure 10, are threaded onto the complementary threads formed on the neck of the container (only a fragment thereof being shown in FIGS. 1 and 2).

Figure 7:
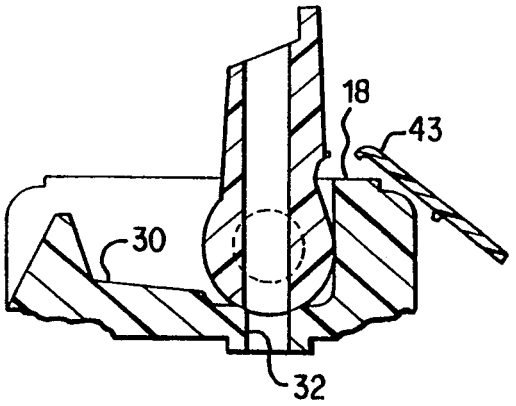

An axial bore 42 extends from the base through the forward end of spout 22. When spout 22 is in its horizontal position, as shown in FIGS. 1 and 3–5, base 34 of the spout blocks aperture 32 and wall 38 covers the end of bore 42. When spout 22 is pivoted 90° into its vertical orientation, as shown in FIG. 7, communication is established between the aperture 32 and bore 42, so that the contents of container 12 may abe discharged through the forward end of bore 42.

Seal 24 comprises a thin resilient tab 43, and one or more ribs 44, 46 that join the tab to the upper surface of spout 22.

FIGS. 3–5 show that the tab 43 of tamper indicating seal 24 is secured to spout 22 at two spaced locations by ribs 44, 46. Rearward rib 44 joins the underside of tab 43 to base 34 of spout 22, while forward rib 46 joins the forward end of tab 43 to the upper surface of spout 22 proximate to recess 48 in the spout. Rib 44 is aligned with the vertical centerline of cylindrical base 34. Ribs 44 and 46 are frangible plastic members, that are strong enough to secure seal 24 to spout 22, yet weak enough to fracture, and/or be crushed, when the spout is initially pivoted toward its opened position.

The seal, comprising tab 24 and ribs 44 and 46, may be integrally molded with spout 22. Subsequently, when the spout is snapped into engagement with the body of the dispensing closure, seed 24 will be properly oriented and aligned relative to the spout and dispensing closure. If any debris is caused by the failures of the ribs during the opening movement of spout 22, such debris will be trapped in recess 48 and will not interfere with subsequent openings of spout 22.

Figure 6:
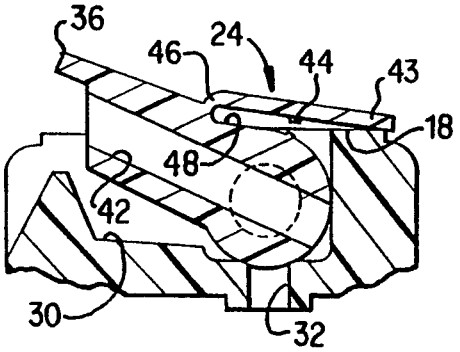
FIGS. 6 and 7 are vertical, cross-sectional views, through a fragment of the dispensing closure, that show progressive steps in the fracture of the tamper evident seal.

FIGS. 6 and 7 show the sequence in which seal 24, including ribs 44, 46, is separated from the upper surface of spout 22. Ribs 44 and 46 secure seal 24 to the upper surface so that the end remote from rib 46 is free and rests upon upper planar surface 18 of dispensing closure 10. When the user exerts an upwardly force on lip 36 of spout 22 to pivot same toward its open position, rib 44 breaks first and frees most of seal 24 from spout 22. As the pivotal movement of spout 22 toward its vertical, open position continues, rib 46 is fractured or severed, thus freeing tab 43. The tab 43 falls away from the spout, and may be returned-to the manufacturer, or store owner, for a rebate, premium, prize, or the like. The spout 22 may then be opened, and closed, several times over the life of the closure, until the contents of the container have been discharged. The absence of seal 24, however, indicates to the consumer that the container has been opened, at least one, and that the contents of the container have been exposed. The debris, if any, from ribs 44, 46 may be retained in recess 48 in the upper surface of the spout.

Figure 8:
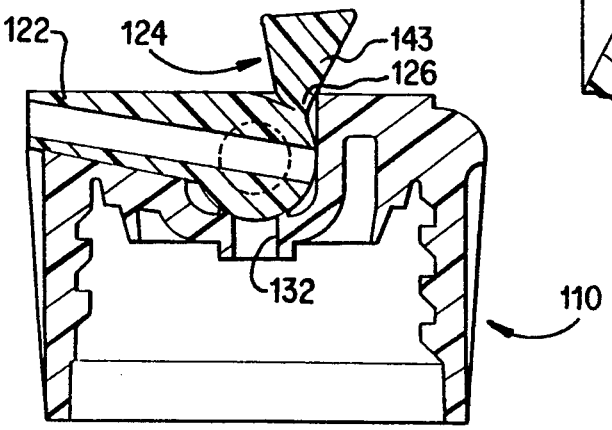
FIG. 8 is a vertical, cross-sectional view of a dispensing closure with an alternative embodiment of the tamper evident seal secured thereto.

FIG. 8 shows an alternative embodiment of the tamper indicating seal. Rather than relying upon ribs 44, 46 to properly align the seal relative to spout 22, the alternative seal, indicated by reference numeral 124, is integrally molded with spout 122 and is joined thereto by a thin neck 126. Seal 124 functions in a manner similar to seal 24, for when spout 122 is pivoted upwardly, for the first time, neck 126 is sheared and tab 143 is freed from spout 122.

Additional revisions to the tamper evident seal, and to the manner of aligning with, and securing same to, the dispensing spout, will occur to the skilled artisan. Such revisions fall squarely within the inventive concept expressed in this application. Consequently, the appended claims are to be interpreted liberally, and should not be restricted to their literal terms.

I claim:

1. In combination, a dispensing closure and a tamper evident seal therefor, a) said dispensing closure including a body with a depending skirt with means adapted to secure same to a container, b) said dispensing closure further including a planar top surface and a cavity defined in said body below said top surface, c) a spout mounted in said cavity for pivotable movement from a horizontal orientation to a vertical orientation, d) a central bore extending axially throughout said spout, e) said spout terminating at one end in a cylindrical base, f) an aperture defined through said body of said closure to establish communication between the interior of the container and said cavity, g) said base of said spout closing said aperture when said spout is in its horizontal position, the invention being characterized in that a tamper indicating seal is secured to said spout and partially overlies same prior to opening said.. spout for the first time, said seal assuming the form of a rigid plastic tab, and frangible means for attaching said tab to the upper surface of said spout, and parallel to the planar surface of said closure.

2. A tamper indicating seal as defined in claim 1 wherein said tab is rectangular in shape, when viewed from above, and said frangible means comprises at least one rib for securing same to said spout.

3. A tamper indicating seal as defined in claim 2 wherein said tab is secured to said spout by two spaced ribs, said ribs being frangible and readily yielding when said spout is pivoted toward its vertical orientation.

4. A tamper indicating seal as defined in claim 2 wherein said tab is secured to said spout by a neck portion of reduced thickness.

5. A tamper indicating seal as defined in claim 2 wherein a recess is formed in the upper surface of said spout, said recess capturing debris generated by the fracture of said frangible means.

6. A tamper indicating seal as defined in claim 2 wherein a rib is aligned with the vertical centerline of said spout when said spout is located in its horizontal position.

7. A tamper indicating seal as defined in claim 1 wherein said tab is aesthetically pleasing, and, when severed from said spout, by the pivoted movement of said spout, is utilized as a proof of purchase indicator.

* * * * *